United States Patent [19]

Myers

[11] 4,282,501

[45] Aug. 4, 1981

[54] BI-DIRECTIONAL LINEAR ACTUATOR

[75] Inventor: John L. Myers, Tipp City, Ohio

[73] Assignee: Ledex, Inc., Vandalia, Ohio

[21] Appl. No.: 69,038

[22] Filed: Aug. 23, 1979

[51] Int. Cl.[3] ..... H01F 7/08; H01F 7/13

[52] U.S. Cl. ..... 335/258; 335/261; 335/266

[58] Field of Search ..... 335/256, 258, 261, 262, 335/264, 266

[56] References Cited

U.S. PATENT DOCUMENTS

| | | | |
|---|---|---|---|
| 2,274,775 | 3/1942 | Cox | 335/266 |
| 2,690,529 | 9/1954 | Lindblad | 335/256 |
| 2,989,666 | 6/1961 | Brenner et al. | 335/256 |
| 3,149,255 | 9/1964 | Trench | 310/30 |
| 3,221,191 | 11/1965 | Cuches et al. | 310/36 |
| 3,241,006 | 3/1966 | Boyko | 335/279 |
| 3,503,022 | 3/1970 | Burdett | 335/256 |
| 3,725,747 | 4/1973 | Cowan | 335/256 |
| 3,805,204 | 4/1974 | Petersen | 335/258 |
| 3,870,931 | 3/1975 | Myers | 318/631 |
| 3,894,275 | 7/1975 | Baumans et al. | 310/12 |
| 3,900,822 | 8/1975 | Hardwick | 335/256 |
| 3,946,851 | 3/1976 | Cestrieres et al. | 335/256 |
| 3,970,981 | 7/1976 | Coors | 335/266 |
| 4,008,448 | 2/1977 | Muggli | 335/258 |
| 4,097,833 | 6/1978 | Myers | 335/261 |

FOREIGN PATENT DOCUMENTS 2458516 6/1976 Fed. Rep. of Germany .

*Primary Examiner*—Harold Broome

*Attorney, Agent, or Firm*—Biebel, French & Nauman

[57] ABSTRACT

An electromagnetic device includes a stator having first and second closed flux-carrying paths defined by first and second cores, each having a plurality of concentric cylindrical pole surfaces and each defining an air gap opening between the outermost of the pole surfaces and the second outermost of the pole surfaces, with each core having at least one further pole surface. Coils are provided for generating electromagnetic flux in the first and second closed flux-carrying paths with the direction of flux flow across the air gaps being substantially radial with respect to the cylindrical pole surfaces. An armature defines a first and a second plurality of concentric cylindrical armature surfaces. The armature is mounted to be movable in a direction substantially parallel to the pole surfaces with each of the first and second cylindrical armature surfaces overlapping a corresponding one of the concentric cylindrical pole surfaces by an area dependent upon the position of the armature. The area of overlap between the outermost pole surfaces and their respective armature surfaces is substantially equal to the sum of the areas of overlap between the others of the pole surfaces and their respective armature surfaces. The pole surfaces are defined by tapered ring portions of the stator, which portions have nonuniform cross-sectional areas in the direction parallel to the direction of movement of the armature. Similarly, the armature surfaces are defined by tapered ring portions of the armature with the tapered portions having nonuniform cross-sectional areas in a direction parallel to the direction of movement of the armature. A plurality of coils may be used to generate the electromagnetic flux in the cores.

11 Claims, 3 Drawing Figures

BI-DIRECTIONAL LINEAR ACTUATOR

BACKGROUND OF THE INVENTION

The present invention relates to an electromagnetic device which converts electrical energy into mechanical energy. Solenoid devices have long been known in which a movable armature element is moved between two positions in response to the application of electrical energy. In general, however, the speed of operation of such devices has been limited by the rather substantial mass of the armatures. Such an armature was required in devices of this type since the electromagnetic flux passed through the armature in a direction parallel to the direction of movement of the armature and it was necessary to provide substantial armature cross-sectional area in order to handle the substantial flux concentration in the armature without saturating.

Various bi-directional solenoids, such as shown in U.S. Pat. No. 2,989,666, issued June 20, 1961, to Brenner et al, have utilized a pair of stator coils which tend to pull an armature in opposite directions. Brenner et al discloses using a circuit for proportioning current to the stator coils such that the armature seeks a position in which the opposing forces applied thereto are balanced. U.S. Pat. No. 3,870,931, issued Mar. 11, 1979, discloses a bi-directional solenoid in which a pair of coils are energized in duty cycle fashion to drive an armature in the desired direction in dependence upon a command signal. Other prior art devices, such as shown in U.S. Pat. No. 2,274,775, issued Mar. 3, 1942, to Cox and U.S. Pat. No. 3,946,851, issued Mar. 30, 1976, to Cestrieres et al, disclose bi-directional solenoid arrangements in which the armature is moved to one of two stable armature positions in response to energization of the coils. By using more than two coils, a device, such as shown in U.S. Pat. No. 3,503,022, issued Mar. 24, 1970, to Burdett, can be constructed in which a discrete number of stable armature positions are attainable by energizing one or more of the solenoid coils.

In order to reduce substantially the mass of the armature of a bi-directional solenoid, thereby enhancing the speed of operation of the solenoid, a bi-directional solenoid operating on a reluctance principle was developed, as shown in U.S. Pat. No. 4,097,833, issued June 27, 1978, to Myers, assigned to the assignee of the present invention. Several of the embodiments disclosed in the Myers patent utilize annular air gaps defined in a pair of opposite-acting stators, with an annular armature arrangement being positioned such that it extends into both of the air gaps simultaneously. Each air gap is defined by a pair of concentric cylindrical pole surfaces with the annular armature overlapping each of the pole surfaces by areas dependent upon the position of the armature. It will be appreciated that with a relatively thin annular armature and narrow air gaps, the overlapping areas on the inner pole surfaces are substantially equal to the overlapping areas on the outer pole surfaces. When, however, the air gap is increased, the overlap areas of the inner pole surfaces will be appreciably less than the overlap areas of the outer pole surfaces. This is somewhat undesirable in a solenoid operating at substantial power levels, since the force generated by the solenoid will depend primarily on varying the smaller of the two overlappping areas, i.e., the inner pole surface overlap.

As shown in U.S. Pat. No. 3,900,822, issued Aug. 19, 1975, to Hardwick et al, assigned to the assignee of the present invention, bi-directional solenoids have taken advantage of the force varying characteristics of tapered pole pieces. The Hardwick et al solenoid, however, requires an armature of substantial mass, since magnetic flux passes through the armature parallel to the direction of movement of the armature.

Accordingly, a need exists for an electromagnetic device in which an annular armature cooperates with an annular air gap of a stator, but in which overlap areas between the inner and outer pole surfaces of the stator and the armature are sufficiently equal such that force is generated as a result of both overlap areas.

SUMMARY OF THE INVENTION

An electromagnetic device includes a stator means comprising a closed flux carrying path including a core having a plurality of concentric cylindrical pole surfaces and an air gap opening defined between a first outer pole surface and a second pole surface, with the second pole surface positioned inwardly of said first pole surface. The core has at least one further pole surface positioned inwardly of the second pole surface. A coil means comprises means for generating electromagnetic flux in the closed flux carrying path with the direction of flux flow across the air gap being generally perpendicular to the pole surfaces. An armature means defines a plurality of concentric cylindrical armature surfaces. The armature means is mounted to be movable in a direction substantially parallel to the pole surfaces, each of the armature surfaces overlapping a corresponding one of the pole surfaces by an area dependent upon the position of the armature means.

The electromagnetic device may be configured such that the area of overlap between the first outer pole surface and its respective armature surface is substantially equal to the sum of the areas of overlap between the second and the further pole surface and their respective armature surfaces.

The electromagnetic device may include a stator means comprising a first closed flux carrying path including a first core having a first plurality of concentric cylindrical pole surfaces and a first air gap opening defined between the outermost of the pole surfaces and the second outermost of the pole surfaces with the core having at least one further pole surface. The stator means may further comprise a second closed flux carrying path including a second core having a second plurality of concentric cylindrical pole surfaces and a second air gap opening defined between the outermost of the second plurality of concentric cylindrical pole surfaces and the second outermost of the second plurality of concentric cylindrical pole surfaces, with the second core having at least one further pole surface.

The coil means generates electromagnetic flux in the first and second closed flux carrying paths with the direction of flux flow across the first and second air gaps being substantially radial with respect to the cylindrical pole surfaces. The armature means defines a first plurality of concentric cylindrical armature surfaces and a second plurality of concentric cylindrical armature surfaces. The armature means is mounted to be movable in a direction substantially parallel to the pole surfaces. Each of the first plurality of concentric cylindrical armature surfaces overlaps a corresponding one of the first plurality of concentric cylindrical pole surfaces by an area dependent upon the position of the armature means. Similarly, each of the second plurality of concentric cylindrical armature surfaces overlaps a corresponding one of the second plurality of concentric cylindrical pole surfaces by an area dependent upon the position of the armature means.

The pole surfaces may be defined by tapered ring portions of the stator means having nonuniform cross-sectional areas in a direction parallel to the direction of movement of the armature means. Further, the armature surfaces may also be defined by tapered ring portions of the armature means having nonuniform cross-sectional areas in a direction parallel to the direction of movement of the armature means.

Accordingly, it is an object of the present invention to provide an electromagnetic device having a stator defining a plurality of concentric cylindrical pole surfaces in which a greater number of pole surfaces are positioned inwardly of an air gap than are positioned radially outward of the air gap, such that overlap areas between the pole surfaces inward of the air gap and the corresponding armature surfaces are substantially equal to the overlap areas between the pole surfaces outwardly of the air gap and the corresponding armature surfaces; to provide such an electromagnetic device in which two pluralities of pole surfaces and armature surfaces are arranged such that the armature means may be moved in either of two directions; and to provide such an electromagnetic device in which the armature surfaces and pole surfaces are defined by tapered portions of the armature means and stator means, respectively.

Other objects and advantages of the invention will be apparent from the following description, the accompanying drawings and the appended claims.

DETAILED DESCRIPTION OF THE PREFERRED EMBODIMENT

Figure 1:
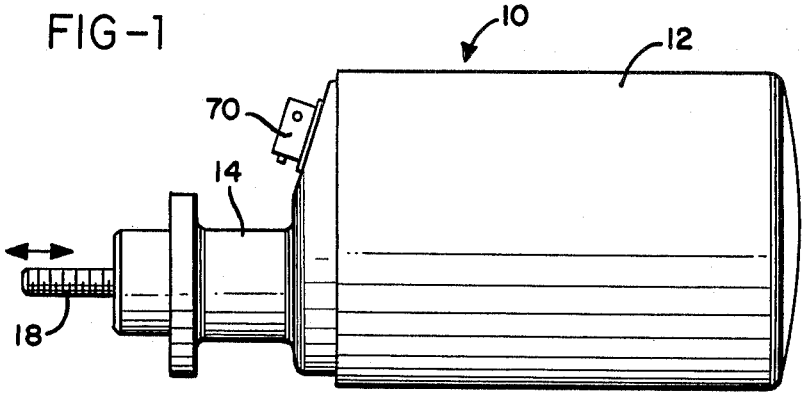
FIG. 1 is a side view of the electromagnetic device of the present invention.
Figure 2:
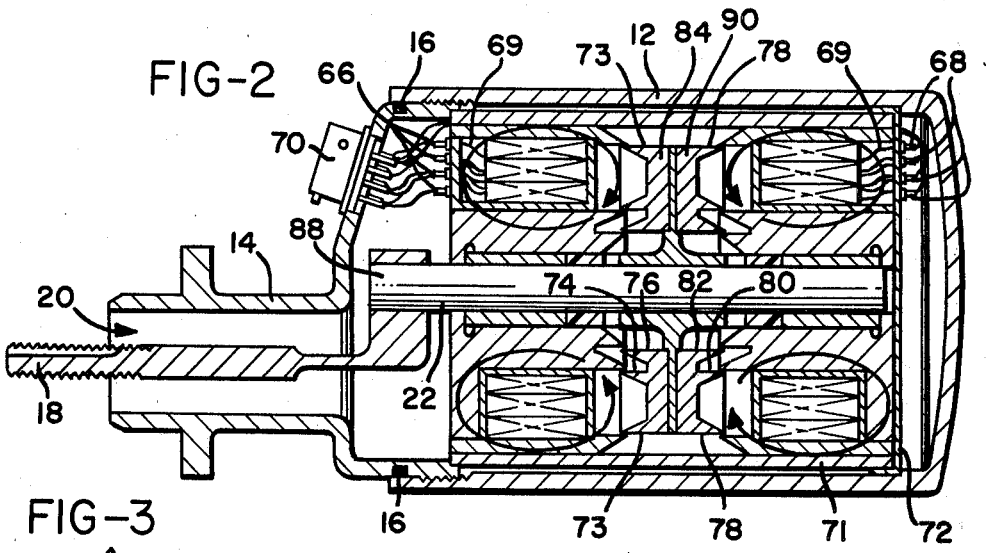
FIG. 2 is a sectional view of the device of FIG. 1, taken in a plane extending axially along the device.
Figure 3:
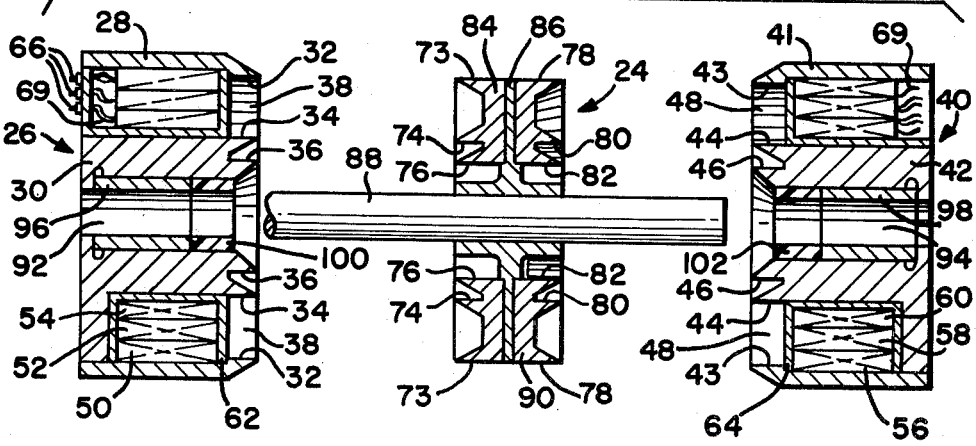
FIG. 3 is a sectional view, similar to FIG. 2, of a portion of the device, with the stator and armature portions pulled apart.

The present invention relates generally to bi-directional electromagnetic devices and, more particularly, to such a device operating on a variable reluctance principle. Reference is made to FIGS. 1-3 which illustrate an embodiment of the electromagnetic device of the present invention. The device is contained within pressure housing 10 which includes casing 12 and end cap 14. As shown in FIG. 2, end cap 14 is threaded into the end of casing 12 and sealing ring 16 provided to ensure a pressure tight housing. Actuator arm 18 extends from opening 20 and is threaded to engage a mechanical coupling. Actuator arm 18 is connected to shaft 22 of an armature means 24 such that it may be moved to the left or to the right, as shown in FIG. 1, upon appropriate energization of the electromagnetic device. As explained below, the actuator arm 18 may be moved to any position within an operating range of travel and, therefore, may be coupled to a device, such as a valve, to control precisely the operation of the valve.

A stator means comprises a first closed flux carrying path through a first core 26 consisting of core members 28 and 30. The first core 26 defines a first plurality of concentric cylindrical pole surfaces 32, 34, and 36, with a first air gap opening 38 defined between the outermost of the pole surfaces 32 and the second outermost of the pole surfaces 34. As shown, the core 26 has at least one further pole surface 36. The stator means further comprises a second closed flux carrying path through a second core 40 consisting of core members 41 and 42. The second core 40 defines a second plurality of concentric cylindrical pole surfaces 43, 44, and 46. A second air gap opening 48 is defined between the outermost of the second plurality of concentric cylindrical surfaces 43 and the second outermost of the second plurality of concentric cylindrical pole surfaces 44. As illustrated, the second core 40 has at least one further pole surface 46. Core elements 28, 30, 41, and 42, are formed of a soft iron or other magnetic material.

A coil means for generating electromagnetic flux in the first and second closed flux carrying paths includes coils 50, 52, 54, 56, 58, and 60. As shown, coils 50, 52, and 54 are concentrically wound on annular coil support 62, while coils 56, 58, and 60 are concentrically wound on annular coil support 64. Each of the coils consists of a plurality of windings of electrically insulated wire, with each of the coils being connected electrically to a separate electrical power driver circuit. Connectors 66 and 68 provide electrical connection to the coils 54-60 via conductors 69. Conductors 69 extend through relatively small slots in the end faces of core elements 30 and 42. Connectors 66 and 68 are electrically connected to a plug connector 70 which provides for connection of the coils to a suitable power source circuit. The stator cores 26 and 40 are contained within cylindrical retainer 71 and retainer end cap 72. By providing redundant coils for generation of flux, the reliability of the electromagnetic device of the present invention is enhanced. As illustrated in FIG. 2, when current passes through the coils, electromagnetic flux is generated in the cores 26 and 40, which flux passes across the air gaps 38 and 48 substantially radially with respect to the cylindrical pole surfaces.

Armature means 24 defines a first plurality of concentric cylindrical armature surfaces 73, 74, and 76 and a second plurality of concentric cylindrical armature surfaces 78, 80, and 82. Surfaces 73, 74, and 76 are defined by armature element 84 which is formed of a magnetic material. Armature element 84 is mounted on one side of a radially extending armature disc element 86 which is pinned or otherwise fastened to armature shaft 88. Disc 86 is preferably constructed of aluminum, stainless steel, or other nonmagnetic material such that its presence does not affect the magnetic flux flow paths. Similarly, armature surfaces 78, 80, and 82 are defined by armature element 90, also formed of a magnetic material and attached to the opposite side of nonmagnetic disc element 86. As shown in FIGS. 2 and 3, shaft 88 extends into openings 92 and 94 defined centrally in cores 26 and 40. Shaft 88 is mounted in openings 92 and 94 by means of sleeve bearings 96 and 98 such that the armature 24 is free to move in a direction substantially parallel to the pole surfaces of the stator means. Alternatively, linear bearings may be substituted for the sleeve bearings 96 and 98. Teflon washers 100 and 102 are positioned in openings 92 and 94, respectively, axially inward of the sleeve bearings 96 and 98.

As shown in FIG. 2, each of the first plurality of concentric cylindrical armature surfaces 73, 74, and 76 overlaps a corresponding pole surface by an area dependent upon the position of the armature means. Similarly, each of the second plurality of concentric cylindrical armature surfaces 78, 80, and 82 overlaps a corresponding cylindrical pole surface by an area dependent upon the position of the armature means 24.

As current is applied to the coils associated with a stator core, flux flow through the core and across the air gap defined by the pole surfaces tends to draw the armature into the air gap. For example, flux flow between pole surface 32 and pole surface 34, acting on armature element 84 via armature surfaces 73 and 74 tends to move the armature to the left as seen in FIG. 2. Similarly, flux flow through the core 40, across air gap 48, acting upon the armature element 90 tends to draw the armature 24 to the right. By adjusting the current supplied to the coils, the amount of flux flowing through each of the two cores may be adjusted, with the result that the opposing forces supplied to the armature may be adjusted to position the armature as desired.

The forces applied to the armature 24 by each of the stator cores result from the change in reluctance of the magnetic flux paths in the cores as the armature portions move into the air gaps. By arranging core elements 28, 30, 41, and 42 such that the pole surfaces are defined by tapered portions of the stator means, having nonuniform cross-sectional areas in the direction parallel to the direction of movement of the armature means, the force versus position characteristic of each overlapping pair of armature and pole surfaces may be adjusted. For instance, as shown in FIG. 2, the force applied to the armature means 24 by the core arrangement 26 decreases as the armature is moved to the left.

If only two pole surfaces were utilized in each core, such as surfaces 32 and 34, it will be appreciated that the overlap area between pole surface 32 and its corresponding armature surface 73 would be substantially greater than the overlap area between pole surface 34 and its corresponding armature surface 74. As a result, the force generated on the armature would be a function only of variation in overlap between the pole surface 34 and armature surface 74. In order to generate substantially higher force in a solenoid arrangement such as the present invention in which substantial power is applied, it is desirable that the area of overlap between the outer pole surface 32 and its armature surface 73 be substantially equal to the area of overlap of the inner pole surface and its corresponding armature surface. It will be appreciated that where the air gap 38 is relatively large and there exists a substantial difference in the radii of the two pole surfaces, however, a substantial difference in the overlap areas associated with these pole surfaces will result. Consequently, at least two pole surfaces positioned radially inward of the air gap are provided for each side of the stator. The sum of the areas of overlap between pole surface 34 and armature surface 74 and between pole surface 36 and armature surface 76 is substantially equal to the area of overlap between the outer pole surface 32 and its respective armature surface 73. Similarly, the sum of the areas of overlap between pole surface 44 and armature surface 80 and between pole surface 46 and armature surface 82 is substantially equal to the area of overlap between the outer pole surface 43 and its respective armature surface 78.

The effective working range of travel of the armature in the embodiment illustrated extends only to the range of positions to which the armature means 24 may be moved while maintaining some overlap between armature surfaces on both armature elements 84 and 90. In the embodiment illustrated, the total range of travel for working purposes is approximately 0.188 inch.

Although a bi-directional solenoid arrangement is illustrated in the drawings, it will be appreciated that the present invention may be employed advantageously in a solenoid capable of actuation only in one direction.

While the form of apparatus herein described consititutes preferred embodiments of the invention, it is to be understood that the invention is not limited to this precise form of apparatus, and that changes may be made therein without departing from the scope of the invention.

What is claimed is:

1. An electromagnetic device, comprising:

stator means comprising a closed flux-carrying path including a core having a plurality of concentric cylindrical pole surfaces and an air gap opening defined between a first outermost pole surface and a second next outermost pole surface, said second pole surface positioned inwardly of said first pole surface, said core having at least one further pole surface positioned inwardly of said second pole surface, coil means comprising means for generating electromagnetic flux in said closed flux carrying path, the direction of flux flow across said air gap being generally perpendicular to said pole surfaces, and armature means, defining a plurality of concentric cylindrical armature surfaces, mounted to be movable in a direction substantially parallel to said pole surfaces, each of said armature surfaces overlapping a corresponding one of said pole surfaces by an area dependent upon the position of said armature means.

2. The electromagnetic device of claim 1 in which the area of overlap between said first outer pole surface and its respective armature surface is substantially equal to the sum of the areas of overlap between said second and said further pole surface and their respective armature surfaces.

3. The electromagnetic device of claim 1 in which said pole surfaces are defined by tapered ring portions of said stator means having nonuniform cross-sectional areas in a direction parallel to the direction of movement of said armature means.

4. The electromagnetic device of claim 1 or 3 in which said armature surfaces are defined by tapered ring portions of said armature means having nonuniform crosssectional areas in a direction parallel to the direction of movement of said armature means.

5. The electromagnetic device of claim 1 in which said coil means comprises a plurality of coils.

6. An electromagnetic device, comprising:

stator means comprising a first closed flux-carrying path including a first core having a first plurality of concentric cylindrical pole surfaces and a first air gap opening defined between the outermost of said ple surfaces and the second outermost of said pole surfaces, said core having at least one further pole surface, and a second closed flux-carrying path including a second core having a second plurality of concentric cylindrical pole surfaces and a second air gap opening defined between the outermost of said second plurality of concentric cylindrical pole surfaces and the second outermost of said second plurality of concentric cylindrical pole surfaces, said second core having at least one further pole surface, coil means for generating electromagnetic flux in said first and second closed flux-carrying paths, the direction of flux flow across said first and second air gaps being substantially radial with respect to said cylindrical pole surfaces, and armature means, defining a first plurality of concentric cylindrical armature surfaces and a second plurality of concentric cylindrical armature surfaces, mounted to be movable in a direction substantially parallel to said pole surfaces, each of said first plurality of concentric cylindrical armature surfaces overlapping a corresponding one of said first plurality of concentric cylindrical pole surfaces by an area dependent upon the position of said armature means and each of said second plurality of concentric cylindrical armature surfaces overlapping a corresponding one of said second plurality of concentric cylindrical pole surfaces by an area dependent upon the position of said armature means.

7. The electromagnetic device of claim 6 in which the area of overlap between said outermost pole surface of said first plurality of concentric cylindrical pole surfaces and its respective armature surface is substantially equal to the sum of the areas of overlap between said second outermost and said further pole surfaces of said first plurality of concentric cylindrical pole surfaces and their respective armature surfaces.

8. The electromagnetic device of claims 6 or 7 in which the area of overlap between said outermost pole surface of said second plurality of concentric cylindrical pole surfaces and its respective armature surface is substantially equal to the sum of the areas of overlap between said second outermost and said further pole surfaces of said second plurality of concentric cylindrical pole surfaces and their respective armature surfaces.

9. The electromagnetic device of claim 6 in which said pole surfaces are defined by tapered ring portions of said stator means having nonuniform cross-sectional areas in a direction parallel to the direction of movement of said armature means.

10. The electromagnetic device of claim 6 or 9 in which said armature surfaces are defined by tapered ring portions of said armature means having nonuniform crosssectional areas in a direction parallel to the direction of movement of said armature means.

11. The electromagnetic device of claim 6 in which said coil means comprises a plurality of coils.

* * * * *

UNITED STATES PATENT AND TRADEMARK OFFICE

CERTIFICATE OF CORRECTION

PATENT NO. : 4,282,501

DATED : August 4, 1981

INVENTOR(S) : John L. Myers

It is certified that error appears in the above—identified patent and that said Letters Patent is hereby corrected as shown below:

Column 6, line 58, "ple" should be --pole--.

Column 3, lines 6 and 7, "cros-ssectional" should be --cross-sectional--.

Signed and Sealed this

*Tenth* Day of *November 1981*

[SEAL]

*Attest:*

GERALD J. MOSSINGHOFF

*Attesting Officer*

*Commissioner of Patents and Trademarks*